US005682078A

United States Patent [19]

Shishido

[11] Patent Number: 5,682,078

[45] Date of Patent: Oct. 28, 1997

[54] ELECTRON GUN HAVING TWO-DIMENSIONAL ARRAYS OF IMPROVED FIELD EMISSION COLD CATHODES FOCUSED ABOUT A CENTER POINT

[75] Inventor: Akira Shishido, Shiga, Japan

[73] Assignee: NEC Corporation, Tokyo, Japan

[21] Appl. No.: 650,368

[22] Filed: May 20, 1996

[30] Foreign Application Priority Data

May 19, 1995 [JP] Japan ..... 7-121219

[51] Int. Cl.[6] ..... H01J 19/24

[52] U.S. Cl. ..... 313/336; 313/309

[58] Field of Search ..... 313/308, 309, 313/495, 336, 351

[56] References Cited

U.S. PATENT DOCUMENTS

| | | | |
|---|---|---|---|
| 4,145,635 | 3/1979 | Tuck | 313/309 |
| 4,874,981 | 10/1989 | Spindt | 313/309 |
| 5,235,244 | 8/1993 | Spindt | 313/495 |
| 5,430,347 | 7/1995 | Kane et al. | 313/309 |
| 5,528,103 | 6/1996 | Spindt et al. | 313/309 |
| 5,543,686 | 8/1996 | Huang et al. | 313/308 |
| 5,552,659 | 9/1996 | Macaulay | 313/309 |

*Primary Examiner*—Michael Horabik
*Assistant Examiner*—Michael Day
*Attorney, Agent, or Firm*—Young & Thompson

[57] ABSTRACT

A field emission cold cathode structure has an insulation layer having two-dimensional arrays of cavities, with a gate electrode on the insulation layer and two-dimensional arrays of opening portions having a generally circular shape positioned over the cavities. Field emission cold cathodes within the cavities each has a cone-like shape with a pointed top. The tops of the field emission cold cathodes are off-center within the opening portions in horizontal directions toward a reference point positioned on the gate electrode, and the distances of the tops from centers of the opening portions are varied to increase in accordance with increase in distance of the field emission cold cathodes from the reference point. This causes deflections of electron beams emitted from the tops of the field emission cold cathodes toward a concentration point which is positioned on a line extending from the reference point in a vertical direction to a surface of the gate electrode.

23 Claims, 2 Drawing Sheets

ELECTRON GUN HAVING TWO-DIMENSIONAL ARRAYS OF IMPROVED FIELD EMISSION COLD CATHODES FOCUSED ABOUT A CENTER POINT

BACKGROUND OF THE INVENTION

The present invention relates to two-dimensional arrays of field emission cold cathodes, each of which has a cone shape with a pointed top from which an electron beam is emitted.

Conventional field emission cold cathodes in the form of two-dimensional arrays are as illustrated in FIG. 1. A silicon oxide layer 4 acting as an insulation layer is provided on a substrate 1 made of an electrically conductive material. The silicon oxide layer 4 has two-dimensional arrays of cavities 3. The cavities 3 have a cylindrical shape. A gate electrode 5 is provided on the silicon oxide layer 4. The gate electrode 5 has two-dimensional arrays of opening portions having a circular shape. The opening portions of the gate electrode 5 are positioned over the cavities 3. Field emission cold cathodes 2 are accommodated within the cavities 3 and placed on the substrate 1. Each of the field emission cold cathodes 2 has a cone shape with a pointed top. The field emission cold cathodes 2 are made of refractory metals, such as tungsten and molybdenum, which have sufficiently low work functions for facilitating emission of electrons from the pointed top of the field emission cold cathodes 2. A top of a center field emission cold cathode 2 is positioned at a reference point corresponding to a center of the gate electrode 5 and also positioned at a center of a center cavity 3 positioned at the center of the gate electrode 5.

The arrays of the cavities 2 are to form a single circle of the cavities 2 singly encompassing the center cavity 2 so as to form a single circle of the field emission cold cathodes 2 singly encompassing the center field emission cold cathode 2.

The tops of the field emission cold cathodes 2 are positioned at centers of the cavities 3 so that application of a bias in the range of a few volts to several tens of volts between the field emission cold cathodes 2 and the gate electrode 5 causes electron beam emissions in a direction vertical to a surface of the gate electrode 5 from the pointed top of the field emission cold cathodes 2. The electron beams having emitted from the pointed tops of the field emission cold cathodes 2 diverge so that the diameters of the beams are enlarged, thereby resulting in deterioration in quality of the electron beams.

In order to settle the above problems, it was proposed to provide a convergence electrode, as illustrated in FIG. 2, which generates a convergence electric field which contributes to the prevention of the divergence of the electron beams emitted from the pointed tops of the field emission cold cathodes. An additional insulation film is provided on the gate electrode 5 and a convergence electrode 6 is provided on the additional insulation film. This technique is disclosed, for example, in the Japanese laid-open patent application No. 6-12974.

If the above field emission cold cathode structure with the convergence electrode is applied to the electron gun for a cathode ray tube, then an intensity of the electron beams are likely to be insufficient due to a small quantity of electrons emitted even with the use of the convergence electrode 6.

In order to address the above issue, it was proposed to provide an electron lens for obtaining a further convergence of the electron beams emitted from the pointed top of the field emission cold cathodes. Actually, however, the direction of the electron beam emission is not controlled. This makes it difficult to do an alignment between the electron lens and the field emission cold cathodes thereby resulting in deterioration of resolution power and in the requirement for carrying out an increased number of processes for the alignment between the electron lens and the field emission cold cathodes.

SUMMARY OF THE INVENTION

Accordingly, it is an object of the present invention to provide a novel field emission cold cathode structure free from the problems as described above.

It is a further object of the present invention to provide a novel field emission cold cathode structure which allows a convergence of electron beams emitted from pointed tops of a large number of field emission cold cathodes.

The above and other objects, features and advantages of the present invention will be apparent from the following descriptions.

The present invention provides a field emission cold cathode structure as follows. An insulation layer has two-dimensional arrays of cavities. A gate electrode is provided on the insulation layer. The gate electrode has two-dimensional arrays of opening portions having a generally circular shape. The opening portions are positioned over the cavities. Field emission cold cathodes are accommodated within the cavities. Each of the field emission cold cathodes has a cone-like shape and has a pointed top. The tops of the field emission cold cathodes are off-centered by distances from centers of the opening portions in horizontal directions toward a reference point positioned on the gate electrode. The distances of the tops from centers of the opening portions are varied to increase in accordance with increase in distance of the field emission cold cathodes from the reference point. This causes deflections of electron beams emitted from the tops of the field emission cold cathodes toward a concentration point which is positioned on a line extending from the reference point in a vertical direction to a surface of the gate electrode.

The present invention provides another field emission cold cathode structure as follows. An insulation layer is provided on a cathode electrode plate. The insulation layer has two-dimensional arrays of cavities having a generally cylindrical shape. A gate electrode is provided on the insulation layer. The gate electrode has two-dimensional arrays of opening portions having a generally circular shape. The opening portions are positioned over the cavities. The field emission cold cathodes are accommodated within the cavities and placed on the cathode electrode plate. Each of the field emission cold cathodes has a cone-like shape and a pointed top. The tops of the field emission cold cathodes are off-centered by distances from centers of the opening portions in horizontal directions toward a reference point positioned on the gate electrode. The distances of the tops from centers of the opening portions are varied to increase in accordance with increase in distance of the field emission cold cathodes from the reference point. This causes deflections of electron beams emitted from the tops of the field emission cold cathodes toward a concentration point which is positioned on a line extending from the reference point in a vertical direction to a surface of the gate electrode.

The present invention provides still another field emission cold cathode structure as follows. An insulation layer is provided on a cathode electrode plate. The insulation layer has two-dimensional arrays of cavities having a generally cylindrical shape. A gate electrode is provided on the insulation layer. The gate electrode has two-dimensional arrays of opening portions having a generally circular shape. The opening portions are positioned over the cavities. Field emission cold cathodes are accommodated within the cavities and placed on the cathode electrode plate. Each of the field emission cold cathodes has a cone shape free of eccentricity. A top of one of the field emission cold cathodes is positioned at a reference point corresponding a center of the gate electrode and also positioned at a center of one cavities, which accommodates of the one of the field emission cold cathodes. Positions of the field emission cold cathodes within the cavities are varied in accordance with distances of the field emission cold cathodes from the reference point. The tops of the field emission cold cathodes are off-centered by distances from centers of the opening portions in horizontal directions toward the reference point. The distances of the tops from centers of the opening portions are varied to linearly increase in accordance with increase in the distance of the field emission cold cathodes from the reference point. Those cause deflections of electron beams emitted from the tops of the field emission cold cathodes toward a concentration point which is positioned on a line extending from the reference point in a vertical direction to a surface of the gate electrode.

BRIEF DESCRIPTIONS OF THE DRAWINGS

Preferred embodiments of the present invention will be described in detail with reference to the accompanying drawings.

DETAILED DESCRIPTION OF THE PREFERRED EMBODIMENT

Figure 1:
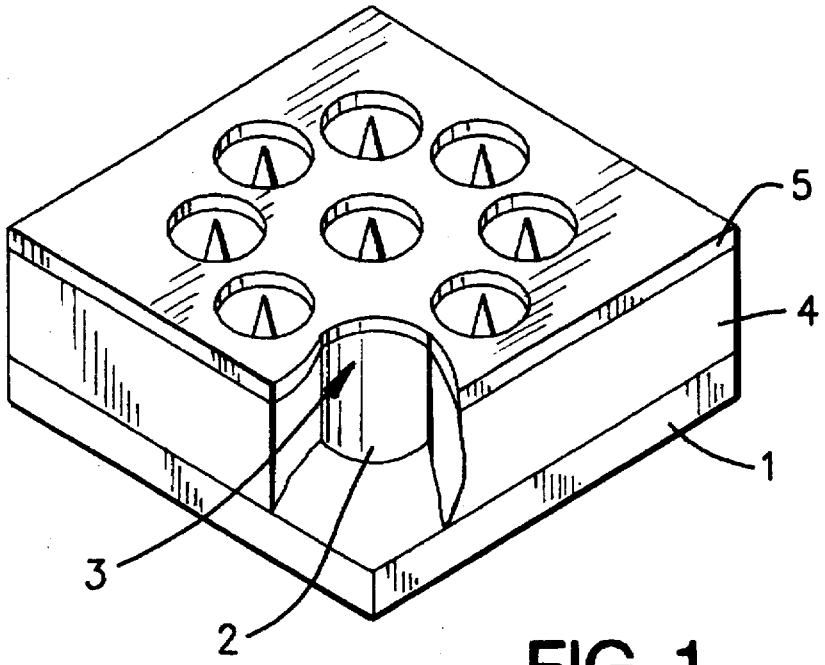
FIG. 1 PRIOR ART
FIG. 1 is a schematic view illustrative of the conventional field emission cold cathode structure.
Figure 2:
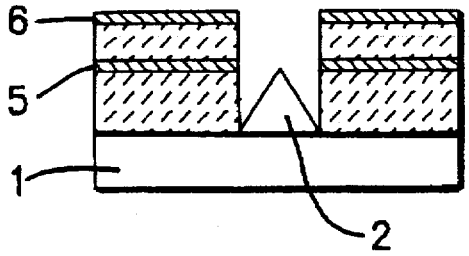
FIG. 2 PRIOR ART
FIG. 2 is a fragmentary cross sectional elevation view illustrative of the other conventional field emission cold cathode structure.

The present invention provides a field emission cold cathode structure as follows. An insulation layer has two-dimensional arrays of cavities. A gate electrode is provided on the insulation layer. The gate electrode has two-dimensional arrays of opening portions having a generally circular shape. The opening portions are positioned over the cavities. Field emission cold cathodes are accommodated within the cavities. Each of the field emission cold cathodes has a cone-like shape and a pointed top. The tops of the field emission cold cathodes are off-centered by distances from centers of the opening portions in horizontal directions toward a reference point positioned on the gate electrode. The distances of the tops from centers of the opening portions are varied to increase in accordance with increase in distance of the field emission cold cathodes from the reference point. This causes deflections of electron beams emitted from the tops of the field emission cold cathodes toward a concentration point which is positioned on a line extending from the reference point in a vertical direction to a surface of the gate electrode.

It is possible that the distances from the centers of the opening portions are varied to linearly increase in accordance with increase in the distances of the field emission cold cathodes from the reference point.

It is also possible that the reference point is positioned at a center of the gate electrode, and a top of one of the field emission cold cathodes is positioned on the reference point and also positioned at a center of one of the cavities, which accommodates the field emission cold cathodes.

It is also possible that the arrays of said cavities are to form a single circle of the cavities encompassing the one of field emission cold cathodes.

Alternatively, it is also possible that the arrays of the cavities form multiple concentric circles of the cavities.

Further, alternatively, it is also possible that the arrays of the cavities form a matrix of the cavities.

In view of facilitation of formation of the field emission cold cathodes, it is preferable that each of the field emission cold cathodes has a cone shape free of eccentricity, and wherein positions of the field emission cold cathodes within the cavities are varied in accordance with the distances of the field emission cold cathodes from the reference point so that the distances of the tops from the centers of the opening portions are varied to increase in accordance with increase in the distance of the field emission cold cathodes from the reference point.

Alternatively, it is also possible that each of the field emission cold cathodes has an eccentric cone shape so that the distances of the tops from the centers of the opening portions are varied to increase in accordance with increase in the distance of the field emission cold cathodes from the reference point.

Further, it is possible that each of the opening portions has a cone shape free of eccentricity.

Furthermore, it is possible that each of the cavities has a cylindrical shape.

Moreover, it is possible to further provide a cathode electrode plate on which the insulation layer and the field emission cold cathodes are provided.

The present invention provides another field emission cold cathode structure as follows. An insulation layer is provided on a cathode electrode plate. The insulation layer has two-dimensional arrays of cavities having a generally cylindrical shape. A gate electrode is provided on the insulation layer. The gate electrode has two-dimensional arrays of opening portions having a generally circular shape. The opening portions are positioned over the cavities. The field emission cold cathodes are accommodated within the cavities and placed on the cathode electrode plate. Each of the field emission cold cathodes has a cone-like shape and a pointed top. The tops of the field emission cold cathodes are off-centered by distances from centers of the opening portions in horizontal directions toward a reference point positioned on the gate electrode. The distances of the tops from centers of the opening portions are varied to increase in accordance with increase in distance of the field emission cold cathodes from the reference point. This causes deflections of electron beams emitted from the tops of the field emission cold cathodes toward a concentration point which is positioned on a line extending from the reference point in a vertical direction to a surface of the gate electrode.

It is possible that the distances from the centers of the opening portions are varied to linearly increase in accordance with increase in the distances of the field emission cold cathodes from the reference point.

It is also possible that the reference point is positioned at a center of the gate electrode, and a top of one of the field emission cold cathodes is positioned on the reference point and also positioned at a center of one of the cavities, which accommodates one of the field emission cold cathodes.

It is also possible that the arrays of said cavities are to form a single circle of the cavities encompassing the one of the field emission cold cathodes.

Alternatively, it is also possible that the arrays of the cavities form multiple concentric circles of the cavities.

Further, alternatively, it is also possible that the arrays of the cavities form a matrix of the cavities.

In view of facilitation of formation of the field emission cold cathodes, it is preferable that each of the field emission cold cathodes has a cone shape free of eccentricity, and wherein positions of the field emission cold cathodes within the cavities are varied in accordance with the distances of the field emission cold cathodes from the reference point so that the distances of the tops from the centers of the opening portions are varied to increase in accordance with increase in the distance of the field emission cold cathodes from the reference point.

Alternatively, it is also possible that each of the field emission cold cathodes has an eccentric cone shape so that the distances of the tops from the centers of the opening portions are varied to increase in accordance with increase in the distance of the field emission cold cathodes from the reference point.

The present invention provides still another field emission cold cathode structure as follows. An insulation layer is provided on a cathode electrode plate. The insulation layer has two-dimensional arrays of cavities having a generally cylindrical shape. A gate electrode is provided on the insulation layer. The gate electrode has two-dimensional arrays of opening portions having a generally circular shape. The opening portions are positioned over the cavities. Field emission cold cathodes are accommodated within the cavities and placed on the cathode electrode plate. Each of the field emission cold cathodes has a cone shape free of eccentricity. A top of one of the field emission cold cathodes is positioned at a reference point corresponding to a center of the gate electrode and also positioned at a center of one cavities, which accommodates of the one of the field emission cold cathodes. Positions of the field emission cold cathodes within the cavities are varied in accordance with distances of the field emission cold cathodes from the reference point. The tops of the field emission cold cathodes are off-centered by distances from centers of the opening portions in horizontal directions toward the reference point. The distances of the tops from centers of the opening portions are varied to linearly increase in accordance with increase in the distance of the field emission cold cathodes from the reference point. Those cause deflections of electron beams having emitted from the tops of the field emission cold cathodes toward a concentration point which is positioned on a line extending from the reference point in a vertical direction to a surface of the gate electrode.

It is also possible that the arrays of said cavities form a single circle of the cavities encompassing one of the field emission cold cathodes.

Alternatively, it is also possible that the arrays of the cavities form multiple concentric circles of the cavities.

Further, alternatively, it is also possible that the arrays of the cavities form a matrix of the cavities.

Figure 3:
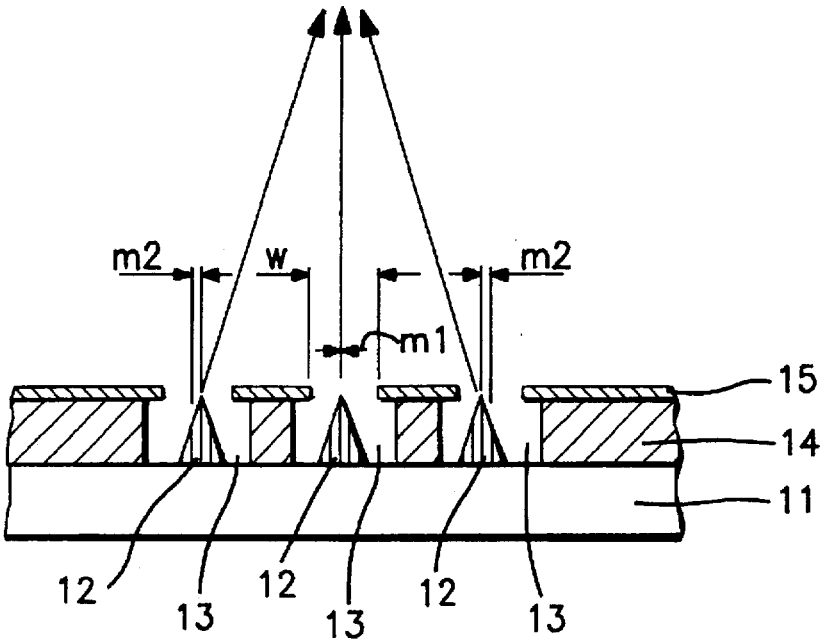
FIG. 3 is a fragmentary cross sectional elevation view illustrative of an improved field emission cold cathode structure in a first embodiment according to the present invention.

A first embodiment according to the present invention will be described with reference to FIG. 3, which provides an improved field emission cold cathode structure as follows. A silicon oxide layer 14 acting as an insulation layer is provided on a substrate 11 made of an electrically conductive material. The silicon oxide layer 14 has two-dimensional arrays of cavities 13. The silicon oxide layer 14 has a thickness of about 1 micrometer. The cavities 13 have a cylindrical shape with a diameter in the range of 1 micrometer to 1.5 micrometers. A gate electrode 15 is provided on the silicon oxide layer 14. The gate electrode 15 has two-dimensional arrays of opening portions having a generally circular shape with a smaller diameter than the diameter of the cylindrically shaped cavities 13. The opening portions are positioned over the cavities 13. Field emission cold cathodes 12 are accommodated within the cavities 13 and placed on the substrate 11. Each of the field emission cold cathodes 12 has a cone shape free of eccentricity and a pointed top. The field emission cold cathodes 12 are made of refractory metals, such as tungsten and molybdenum, which have sufficiently low work functions for facilitating emission of electrons from the pointed top of the field emission cold cathodes 12. A top of a center field emission cold cathode 12 is positioned at a reference point corresponding to a center of the gate electrode 15 and also positioned at a center of a center cavity 13 positioned at the center of the gate electrode 15.

The arrays of the cavities 12 form a single circle of the cavities 12 encompassing the center cavity 12 so as to form a single circle of the field emission cold cathodes 12 encompassing the center field emission cold cathode 12.

Positions of the field emission cold cathodes 12 within the cavities 13 are varied in accordance with distances of the field emission cold cathodes 12 from the reference point positioned at a center of the gate electrode 15. The center field emission cold cathode 12 is centered at a center of the center cavity 14 so that the center field emission cold cathode 12 emits an electron beam with no deflection in a direction vertical to the surface of the gate electrode 15. On the other hand, the tops of the field emission cold cathodes 12 forming a circle encompassing the center field emission cold cathode 12 are off-centered by a distance "m2" from centers of the opening portions of the gate electrode 15 in horizontal directions toward the reference point positioned at the center of the gate electrode 15. Those cause a deflection of electron beams emitted from the tops of the field emission cold cathodes 12 except for the center field emission cold cathode 12 toward a concentration point which is positioned on a line extending from the reference point in a vertical direction to a surface of the gate electrode 15. In operations, a bias of about a few volts is applied to between the field emission cold cathodes 12 and the gate electrode 15. The center field emission cold cathode 12 emits an electron beam with no deflection in a direction vertical to the surface of the gate electrode 15. On the other hand, the field emission cold cathodes 12 forming a circle encompassing the center field emission cold cathode 12 do emit electron beams with a deflection toward a concentration point which is positioned on the line extending from the reference point in the vertical direction to the surface of the gate electrode 15. The concentration, namely weak convergence, of the electron beams toward the concentration point improves the focusing property and resolution power of the electron beams.

The above field emission cold cathode structure is applicable not only to an electron gun accommodated in a bulb or a vacuum tube of a cold cathode ray tube but also a flat panel display device.

The above described field emission cold cathode having the cone shape may be formed in the same manner as disclosed, for example, in Journal of Applied Physics, Vol. 39, No. 7, pp. 3504, 1968. During a rotation of the substrate 11, aluminum is deposited in an oblique direction on the substrate 11 to form a base layer thereon. A photo-resist material is applied for exposure and development in order to form a photo-resist pattern which is used for define the base layer to be off-centered from a center of the opening portion of the gate electrode 15. A refractory metal is then deposited in a direction just vertical to the surface of the gate electrode 15 so that the center field emission cold cathode 12 has a pointed top which is centered at a center of the opening portion of the center cavity 13, whilst the field emission cold cathodes 12 forming a circle encompassing the center field emission cold cathode 12 have pointed tops which are off-centered by a distance "m2" from the centers of the cavities 13.

Figure 4:
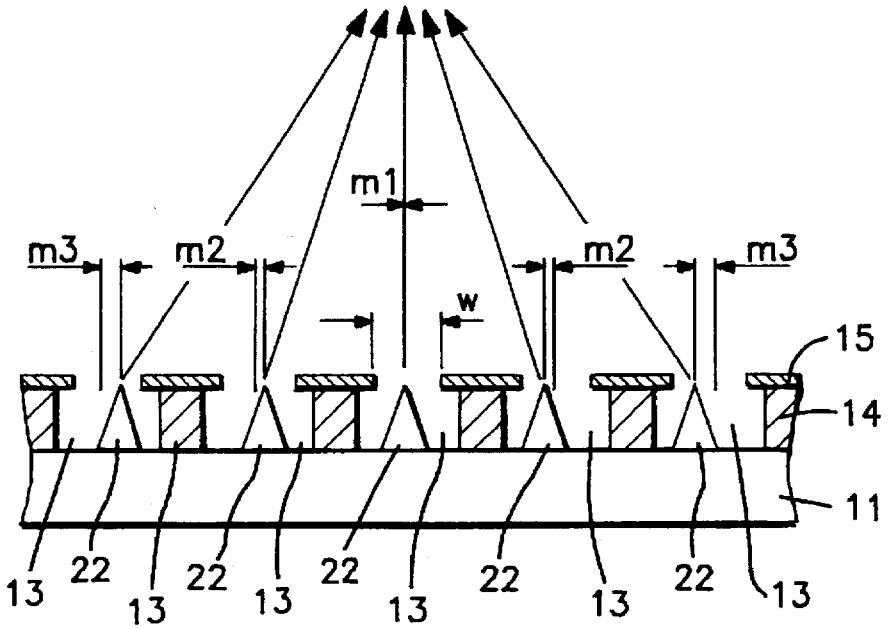
FIG. 4 is a fragmentary cross sectional elevation view illustrative of an improved field emission cold cathode structure in a first embodiment according to the present invention.

A second embodiment according to the present invention will be described with reference to FIG. 4, which provides another improved field emission cold cathode structure as follows. A silicon oxide layer 14 acting as an insulation layer is provided on a substrate 11 made of an electrically conductive material. The silicon oxide layer 14 has two-dimensional arrays of cavities 13. The silicon oxide layer 14 has a thickness of about 1 micrometer. The cavities 13 have a cylindrical shape with a diameter in the range of 1 micrometer to 1.5 micrometers. A gate electrode 15 is provided on the silicon oxide layer 14. The gate electrode 15 has two-dimensional arrays of opening portions having a generally circular shape with a smaller diameter than the diameter of the cylindrically shaped cavities 13. The opening portions are positioned over the cavities 13. Field emission cold cathodes 12 are accommodated within the cavities 13 and placed on the substrate 11. Each of the field emission cold cathodes 12 has a cone shape free of eccentricity and a pointed top. The field emission cold cathodes 12 are made of refractory metals, such as tungsten and molybdenum, which have sufficiently low work functions for facilitating emission of electrons from the pointed top of the field emission cold cathodes 12. A top of a center field emission cold cathode 12 is positioned at a reference point corresponding to a center of the gate electrode 15 and also positioned at a center of a center cavity 13 positioned at the center of the gate electrode 15.

The arrays of the cavities 12 form a single circle of the cavities 12 encompassing the center cavity 12 so as to form multiple concentric circles encompassing the center field emission cold cathode 12.

Positions of the field emission cold cathodes 12 within the cavities 13 are varied in accordance with distances of the field emission cold cathodes 12 from the reference point positioned at a center of the gate electrode 15. The center field emission cold cathode 12 is centered at a center of the center cavity 14 so that the center field emission cold cathode 12 emits an electron beam with no deflection in a direction vertical to the surface of the gate electrode 15. On the other hand, the tops of the field emission cold cathodes 12 forming multiple concentric circles encompassing the center field emission cold cathode 12 are off-centered by distances "m2" and "m3" from centers of the opening portions of the gate electrode 15 in horizontal directions toward the reference point positioned at the center of the gate electrode 15. The distances of the tops of the field emission cold cathodes 12 from centers of the opening portions of the gate electrode 15 are varied to linearly increase in accordance with increase in the distance of the field emission cold cathodes 12 from the reference point positioned at the center of the gate electrode 15. Namely, the distance "m3" is larger than the distance "m2". Those cause deflections of electron beams having emitted from the tops of the field emission cold cathodes 12 except for the center field emission cold cathode 12 toward a concentration point which is positioned on a line extending from the reference point in a vertical direction to a surface of the gate electrode 15. In operations, a bias of about a few volts is applied between the field emission cold cathodes 12 and the gate electrode 15. The center field emission cold cathode 12 emits an electron beam with no deflection in a direction vertical to the surface of the gate electrode 15. On the other hand, the field emission cold cathodes 12 forming a circle encompassing the center field emission cold cathode 12 do emit electron beams with deflections toward a concentration point which is positioned on the line extending from the reference point in the vertical direction to the surface of the gate electrode 15. The concentration, namely weak convergence, of the electron beams toward the concentration point improves the focusing property and resolution power of the electron beams.

The above field emission cold cathode structure is applicable not only to an electron gun accommodated in a bulb or a vacuum tube of a cold cathode ray tube but also a flat panel display device.

The above described field emission cold cathode having the cone shape may be formed in the same manner as described in the first embodiment.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A field emission cold cathode structure comprising:

an insulation layer having two-dimensional arrays of cavities;

a gate electrode being provided on said insulation layer, said gate electrode having two-dimensional arrays of opening portions having a generally circular shape, said opening portions being positioned over said cavities; and field emission cold cathodes being accommodated within said cavities, each of said field emission cold cathodes having a cone-like shape and having a pointed top, wherein said tops of said field emission cold cathodes are off-centered by distances from centers of said opening portions in horizontal directions toward a reference point positioned on said gate electrode, and said distances of said tops from centers of said opening portions are varied to increase in accordance with increase in distance of said field emission cold cathodes from said reference point, to thereby cause deflections of electron beams emitted from said tops of said field emission cold cathodes toward a concentration point which is positioned on a line extending from said reference point in a vertical direction to a surface of said gate electrode.

2. The field emission cold cathode structure as claimed in claim 1, wherein said distances from said centers of said opening portions are varied to linearly increase in accordance with increase in said distances of said field emission cold cathodes from said reference point.

3. The field emission cold cathode structure as claimed in claim 1, wherein said reference point is positioned at a center of an aperture formed in said gate electrode, and a top of one of said field emission cold cathodes is positioned on said reference point and also positioned at a center of one of said cavities, which accommodates said one of said field emission cold cathodes.

4. The field emission cold cathode structure as claimed in claim 3, wherein said arrays of said cavities form a single circle of said cavities encompassing said one of said field emission cold cathodes.

5. The field emission cold cathode structure as claimed in claim 3, wherein said arrays of said cavities form multiple concentric circles of said cavities encompassing said one of said field emission cold cathodes.

6. The field emission cold cathode structure as claimed in claim 1, wherein said arrays of said cavities form a matrix of said cavities.

7. The field emission cold cathode structure as claimed in claim 1, wherein each of said field emission cold cathodes has a cone shape free of eccentricity, and wherein positions of said field emission cold cathodes within said cavities are varied in accordance with said distances of said field emission cold cathodes from said reference point so that said distances of said tops from said centers of said opening portions are varied to increase in accordance with increase in said distance of said field emission cold cathodes from said reference point.

8. The field emission cold cathode structure as claimed in claim 1, wherein each of said field emission cold cathodes has an eccentric cone shape so that said distances of said tops from said centers of said opening portions are varied to increase in accordance with increase in said distance of said field emission cold cathodes from said reference point.

9. The field emission cold cathode structure as claimed in claim 1, wherein each of said opening portions has a cone shape free of eccentricity.

10. The field emission cold cathode structure as claimed in claim 1, wherein each of said cavities has a cylindrical shape.

11. The field emission cold cathode structure as claimed in claim 1, further comprising a cathode electrode plate on which said insulation layer and said field emission cold cathodes are provided.

12. A field emission cold cathode structure comprising:

a cathode electrode plate;

an insulation layer provided on said cathode electrode plate, said insulation layer having two-dimensional arrays of cavities having a generally cylindrical shape;

a gate electrode being provided on said insulation layer, said gate electrode having two-dimensional arrays of opening portions having a generally circular shape, said opening portions being positioned over said cavities; and field emission cold cathodes being accommodated within said cavities and being placed on said cathode electrode plate, each of said field emission cold cathodes having a cone-like shape and having a pointed top, wherein said tops of said field emission cold cathodes are off-centered by distances from centers of said opening portions in horizontal directions toward a reference point positioned on said gate electrode, and said distances of said tops from centers of said opening portions are varied to increase in accordance with increase in distance of said field emission cold cathodes from said reference point, to thereby cause deflections of electron beams emitted from said tops of said field emission cold cathodes toward a concentration point which is positioned on a line extending from said reference point in a vertical direction to a surface of said gate electrode.

13. The field emission cold cathode structure as claimed in claim 12, wherein said distances from said centers of said opening portions are varied to linearly increase in accordance with increase in said distances of said field emission cold cathodes from said reference point.

14. The field emission cold cathode structure as claimed in claim 12, wherein said reference point is positioned at a center of an aperture formed in said gate electrode, and a top of one of said field emission cold cathodes is positioned on said reference point and also positioned at a center of one of said cavities, which accommodates said one of said field emission cold cathodes.

15. The field emission cold cathode structure as claimed in claim 14, wherein said arrays of said cavities form a single circle of said cavities encompassing said one of said field emission cold cathodes.

16. The field emission cold cathode structure as claimed in claim 14, wherein said arrays of said cavities form multiple concentric circles of said cavities encompassing said one of said field emission cold cathodes.

17. The field emission cold cathode structure as claimed in claim 12, wherein said arrays of said cavities form a matrix of said cavities.

18. The field emission cold cathode structure as claimed in claim 12, wherein each of said field emission cold cathodes has a cone shape free of eccentricity, and wherein positions of said field emission cold cathodes within said cavities are varied in accordance with said distances of said field emission cold cathodes from said reference point so that said distances of said tops from said centers of said opening portions are varied to increase in accordance with increase in said distance of said field emission cold cathodes from said reference point.

19. The field emission cold cathode structure as claimed in claim 12, wherein each of said field emission cold cathodes has an eccentric cone shape so that said distances of said tops from said centers of said opening portions are varied to increase in accordance with increase in said distance of said field emission cold cathodes from said reference point.

20. A field emission cold cathode structure comprising:

a cathode electrode plate;

an insulation layer provided on said cathode electrode plate, said insulation layer having two-dimensional arrays of cavities having a generally cylindrical shape;

a gate electrode being provided on said insulation layer, said gate electrode having two-dimensional arrays of opening portions having a generally circular shape, said opening portions being positioned over said cavities; and field emission cold cathodes being accommodated within said cavities and being placed on said cathode electrode plate, each of said field emission cold cathodes having a cone shape free of eccentricity, a top of one of said field emission cold cathodes is positioned at a reference point corresponding to a center of an aperture formed in said gate electrode and also positioned at a center of one of said cavities, which accommodates said one of said field emission cold cathodes, wherein positions of said field emission cold cathodes within said cavities are varied in accordance with distances of said field emission cold cathodes from said reference point, so that said tops of said field emission cold cathodes are off-centered by distances from centers of said opening portions in horizontal directions toward said reference point, and said distances of said tops from centers of said opening portions are varied to linearly increase in accordance with increase in said distance of said field emission cold cathodes from said reference point, to thereby cause deflections of electron beams emitted from said tops of said field emission cold cathodes toward a concentration point which is positioned on a line extending from said reference point in a vertical direction to a surface of said gate electrode.

21. The field emission cold cathode structure as claimed in claim 20, wherein said arrays of said cavities form multiple concentric circles of said cavities.

22. The field emission cold cathode structure as claimed in claim 20, wherein said arrays of said cavities form a single circle of said cavities encompassing said one of said field emission cold cathodes.

23. The field emission cold cathode structure as claimed in claim 20, wherein said arrays of said cavities form a matrix of said cavities encompassing said one of said field emission cold cathodes.

* * * * *